United States Patent [19]

Pepper

[11] Patent Number: 4,993,350

[45] Date of Patent: Feb. 19, 1991

[54] PONTOON LOG AND METHOD OF MAKING SAME

[75] Inventor: Geoffrey T. Pepper, Lebanon, Mo.

[73] Assignee: Outboard Marine Corporation, Waukegan, Ill.

[21] Appl. No.: 540,368

[22] Filed: Jun. 19, 1990

[51] Int. Cl.[5] ..... B63B 1/12

[52] U.S. Cl. ..... 114/292; 114/61; 114/267; 114/356

[58] Field of Search ..... 114/49, 61, 123, 263, 114/266, 267, 283, 292, 356

[56] References Cited

U.S. PATENT DOCUMENTS

| | | | |
|---|---|---|---|
| 3,134,113 | 5/1964 | Boyington et al. . | |
| 3,345,967 | 10/1967 | Sweet . | |
| 3,426,716 | 2/1969 | Hackworth | 114/61 |
| 3,465,486 | 9/1969 | Rolin . | |
| 3,585,955 | 6/1971 | Cella | 114/61 |
| 3,796,175 | 3/1974 | Ford et al. | 114/61 |
| 3,840,926 | 10/1974 | Stoeberl . | |
| 3,970,402 | 7/1976 | Yamashita . | |
| 4,627,373 | 12/1986 | Nishida . | |
| 4,777,898 | 10/1988 | Faulkner . | |

*Primary Examiner*—Sherman Basinger
*Assistant Examiner*—Thomas J. Brahan
*Attorney, Agent, or Firm*—John T. Synnestvedt; Richard D. Weber

[57] ABSTRACT

A pontoon log is formed by welding the upper flanged edges of a U-shaped hull member to the side edges of a flat top plate. At points at which the deck beams are to be attached to the log, the log top plate is notched and the weld is continued around the perimeter of each notch. The deck beams are bolted to the pontoon log with the bolts passing only through the hull flange in the region of the notches and hence outboard of the weld line. The modified embodiments, various types of spacers and clips are provided to reinforce the hull flange in the region of deck beam attachment.

12 Claims, 3 Drawing Sheets

FIG. 7
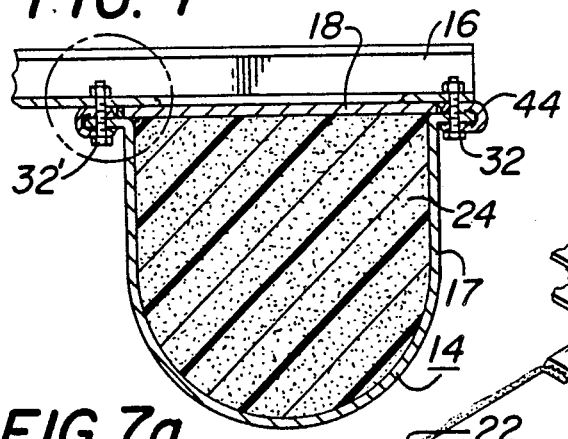
FIG. 8
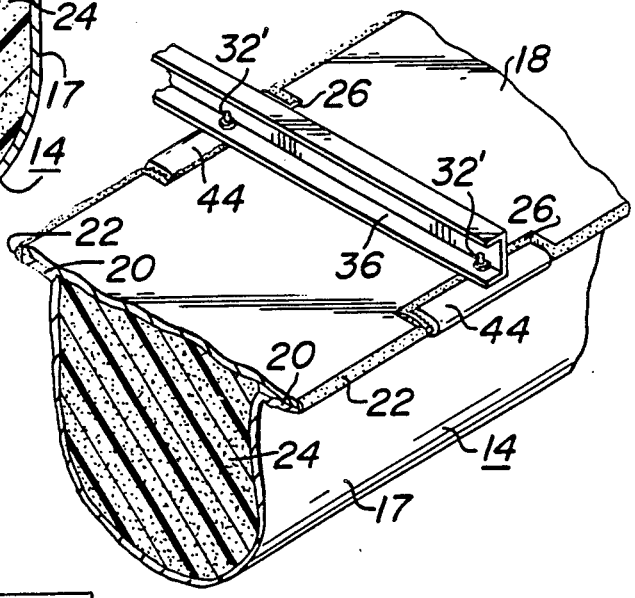
FIG. 7a
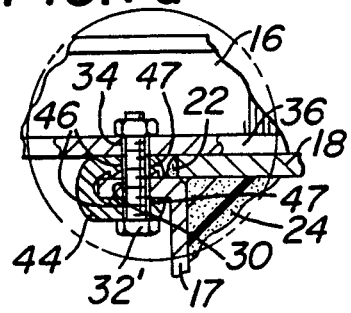
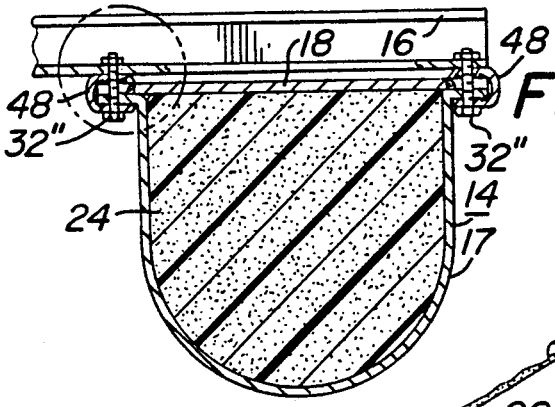
FIG. 9
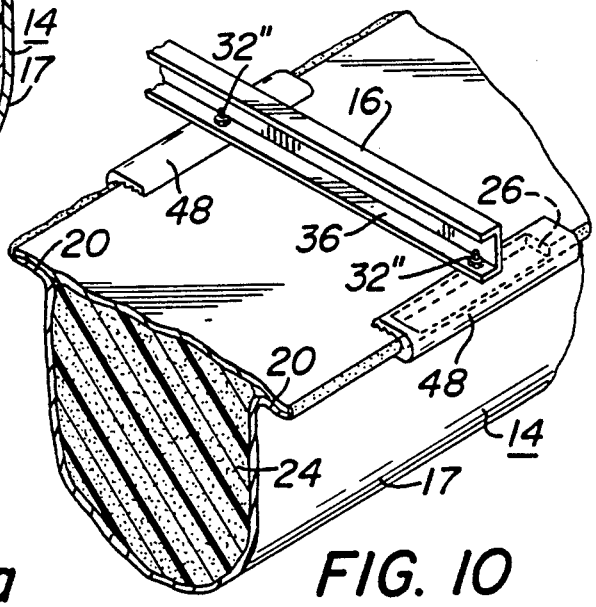
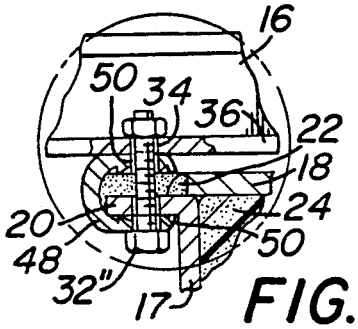
FIG. 9a
FIG. 10

PONTOON LOG AND METHOD OF MAKING SAME

BACKGROUND OF THE INVENTION

1. Field of the Invention

The present invention relates generally to pontoon boats characterized generally by a pair of pontoon logs held in spaced parallel relation by deck beams. More particularly, the invention relates to the method of attaching the deck beams to the pontoon logs and the pontoon log construction resulting from said method.

2. Description of Related Art

Pontoon boats, also known simply as pontoons, are increasing in popularity in view of their stability, large capacity, low maintenance and safety. A particular advantage of a pontoon boat is the fact that the pontoon logs are sealed, and the boat will not take on water from spray, waves or rain. The logs can be filled with a closed cell foam to ensure the requisite degree of flotation even in the event of log rupture, as might occur upon grounding or collision.

The construction of the pontoon logs have been generally of two different types; the more common log construction comprising a U-shaped hull in section to which is attached a flat top plate, and the less common cylindrically shaped log. The latter type of log presents particular difficulties in the attachment of the deck beams, requiring brackets or saddles involving log penetrating fittings which present the possibility of leakage.

With the U-shaped log hull shape, to which the present invention is directed, the transverse deck beams which join the logs and which support the pontoon deck are more readily attached to the logs in view of the planar log top surfaces. In a known construction, the sheet metal skin defining the U-shaped hull of the log includes outturned flanges along its upper edge where it intersects the log top plate. The edges of the log top plate extend over the hull flanges and the log top and hull are joined by welding the overlapped log top and flanges along their outer edges. The deck beams are attached by bolting through the lapped hull flanges and top plate. However, since the bolts are located interiorly of the weld line, the bolts must be sealed by caulking to prevent water penetration into the log interior. With time, the working of the bolts and the deterioration of the caulking material results in the passage of water into the log interior.

An alternate method of securing the hull flange to the top plate and for securing the deck beams to the hull is shown in U.S. Pat. No. 4,777,898, issued Oct. 18, 1988. This patent proposes the use of a sealing tape the length of the log joint between the hull flange and the top plate. A U-shaped clip having gripping toothed internal surfaces is forced over the sandwiched hull flange, seal strip and top plate, following which fastening means such as rivets are positioned at intervals along the edge to form a sealed log which does not require caulking. The attachment of the deck beams is accomplished by through-bolting through the clip and the enclosed top plate, seal strip and hull flange.

This patented construction has not proved entirely watertight and adds additional elements to the joint such as the clip and the seal strip with a consequent additional material and labor expense. Furthermore, the construction introduces assembly complexities, particularly at the bow of the logs where transition is made to a welded construction.

SUMMARY OF THE INVENTION

In the present construction, the flanges of the U-shaped hull member are welded along their outer edges to the log top plate. At points at which the deck beams are to be attached to the logs, the log top plate is notched and the weld is continued around the perimeter of each notch. Bolt holes for the deck beam bolts pass only through the flange of the hull member outboard of the notch weld line and hence the bolt holes are isolated from the sealed interior of the log. Caulking of the bolt holes is accordingly unnecessary and leakage cannot occur even if the bolts should work in the holes to cause hole enlargement.

In a first embodiment of the invention, the notch openings in the log top plate are allowed to remain open, and the bolts connecting the hole flange with the deck beams simply pass through the notch openings. In a second embodiment of the invention, a washer or plate is inserted in the notch openings having the same thickness as the top plate to permit the bolts to be tightened without danger of deforming the hole flange and/or the deck beam. In a third embodiment, a clip is provided which is disposed within the notches and extends over the upper and lower surfaces of the exposed hole flange portions, and in a fourth embodiment a larger clip is provided which extends longitudinally beyond the notches and envelops both the hull flange and the edge of the top plate.

It is accordingly a first object of the present invention to provide an improved pontoon log and method of making the same which isolates the deck beam bolt holes from the sealed interior of the pontoon, thereby eliminating any possibility of leakage associated with the bolted connection of the pontoon logs to the deck beams.

A further object of the invention is to provide a pontoon log and method as described, wherein the sealing of the log cavity is effected entirely by welding, thus eliminating reliance on resilient seals, caulking or the like, the sealing capability of which is apt to diminish with time and usage.

A still further object of the invention is to provide a pontoon log and method as described of a simple, economical construction which can be readily carried out with a minimal amount of tooling.

Still another object of the invention is to provide a pontoon log and method as described which can be readily carried out by workers with a relatively low skill level without compromising the quality of the product.

Additional advantages of the invention will be more readily apparent to those skilled in the art from the following detailed description of preferred embodiments of the invention as illustrated in the accompanying drawings.

BRIEF DESCRIPTION OF THE DRAWINGS

FIG. 7 illustrates a second modified embodiment of the invention and is a sectional view through a pontoon log at the point of connection with a deck beam;

FIG. 7*a* is a enlarged sectional view of that portion of FIG. 7 encircled in broken lines;

FIG. 8 is a perspective view showing the log/beam connection illustrated in FIGS. 7 and 7*a;*

FIG. 9 illustrates a third modified embodiment of the invention and is a sectional view through a pontoon log at the point of connection with a deck beam;

FIG. 9*a* is an enlarged sectional view of that portion of FIG. 9 encircled in broken lines; and FIG. 10 is a perspective view showing the log/beam connection illustrated in FIGS. 9 and 9*a*.

DESCRIPTION OF THE PREFERRED EMBODIMENTS

Figure 1:
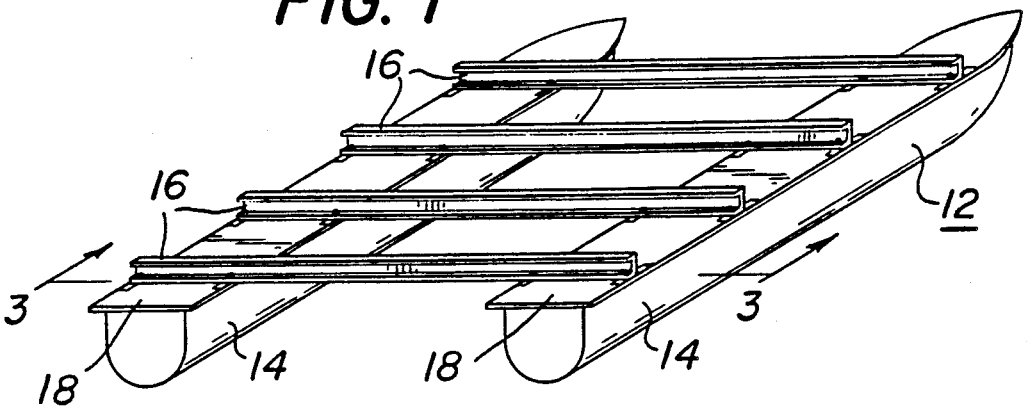
FIG. 1 is a perspective view showing a pair of pontoon logs joined together by a plurality of transverse deck beams, the pontoon logs and their method of attachment to the deck beams being carried out in accordance with the present invention.

Referring to the drawings and particularly FIG. 1 thereof, a pontoon boat generally designated 12 is illustrated at a stage of construction wherein the pair of substantially identical pontoon logs 14 thereof are secured in spaced parallel relation by a plurality of spaced transverse deck beams 16. To complete the boat, suitable decking will be applied to the deck beams, to which are added additional conventional equipment such as a motor mount, steering gear, rails, etc. The focus of the present invention is the manner of attachment of the transverse deck beams 16 to the pontoon logs 14.

Figure 2:
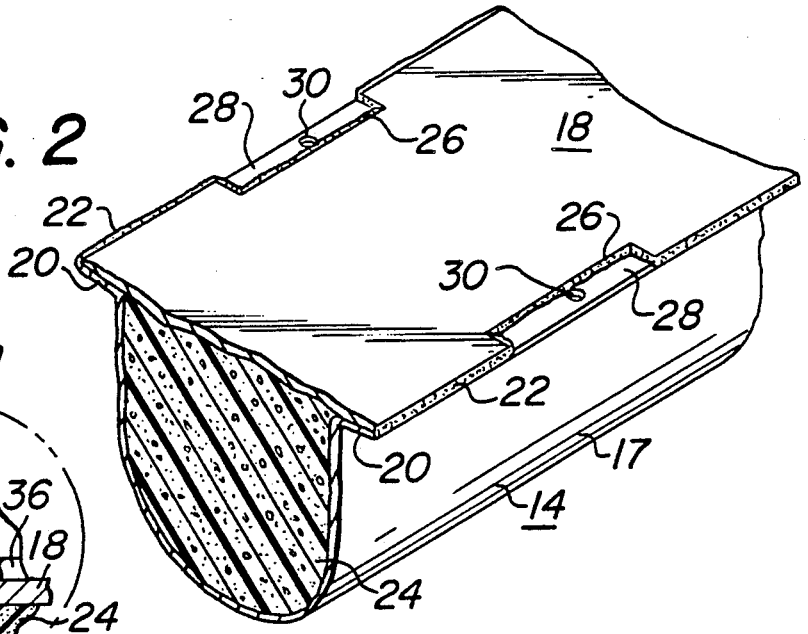
FIG. 2 is an enlarged perspective view partly in section of a portion of one of the pontoon logs of the pontoon of FIG. 1.
Figure 3A:
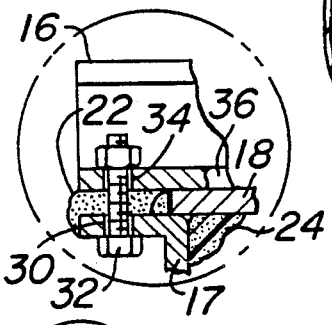
FIG. 3*a* is an enlarged partial sectional view of the portion of FIG. 3 encircled in broken lines.
Figure 3:
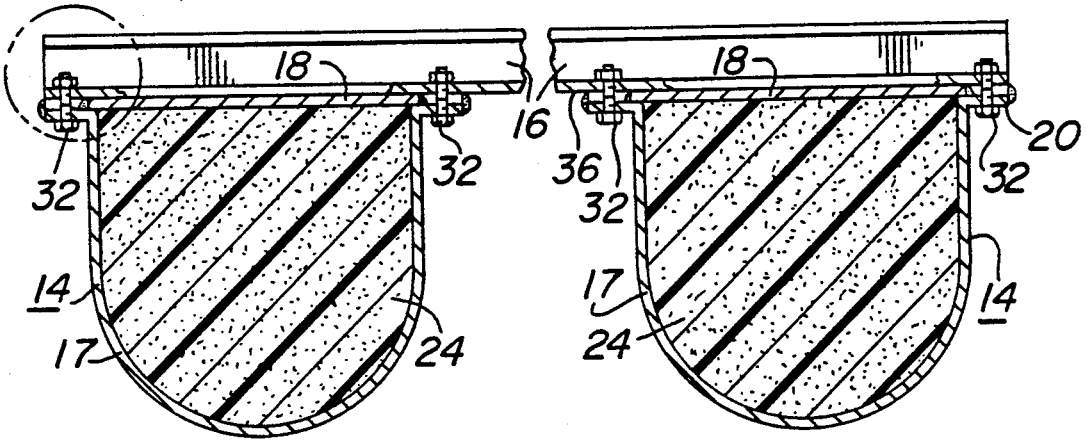
FIG. 3 is an enlarged sectional view taken along line 3—3 of FIG. 1.
Figure 4:
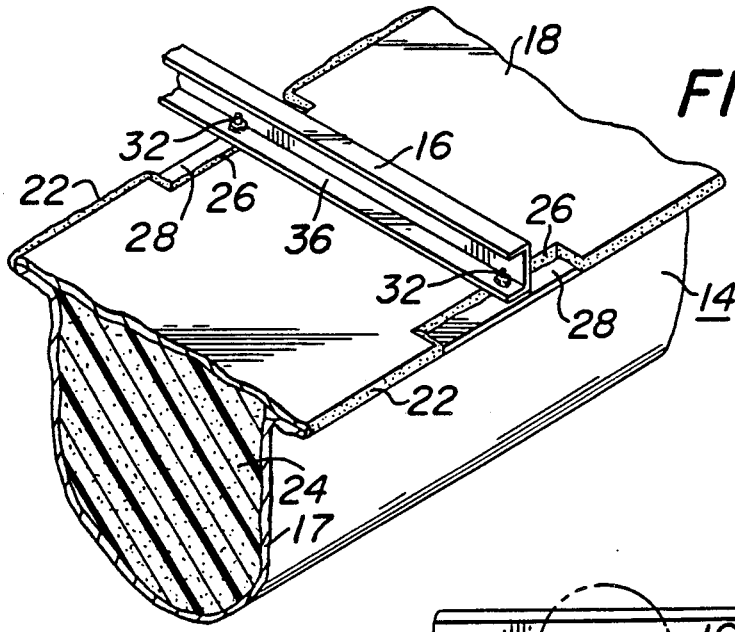
FIG. 4 is an enlarged view similar to FIG. 2 but showing a portion of a deck beam attached to the pontoon log.

As shown in the enlarged views of FIGS. 2–4, each of the pontoon logs 14 is formed of a substantially U-shaped sheet metal hull member 17 and a sheet metal log top plate 18. The hull member 17 includes outwardly directed flanges 20 extending along its upper edges, which flanges are overlapped by the top plate 18. The side edges of the top plate 18 and the outer edges of the flanges 20 are welded along a weld line 22 extending around the entire perimeter of the top plate to effectively secure the hull to the top plate in a strong, watertight manner.

As is conventional with this type boat, the pontoon logs are preferably fabricated of an aluminum alloy in view of its strength and light weight. The interior of the logs may be filled with a closed cell foam 24, either cast in place, as illustrated, or cut to fit within the pontoon log. Since the pontoon logs are sealed by the welded construction, the foam is provided as an emergency measure to provide buoyancy in the event of a rupture of the log, such as by grounding or collision.

As mentioned, pontoon boats have been built by bolting the deck beams through the flanges 20 and overlying deck plate. With such construction, it was necessary to caulk each bolt hole at the time of assembly, since the bolt holes were located interiorly of the weld line, permitting any water penetration through the bolt holes to pass into the interior of the pontoon log. Such construction could lead to leakage for a number of reasons, including inadequate caulking of the holes upon assembly, deterioration of the caulking material over time, enlargement of the bolt holes during boat usage, or loosening of the bolts. The described prior construction is accordingly not satisfactory, since even a slow accumulation of water in a pontoon log can create a serious problem, particularly if flotation materials are not present within the log.

In the present invention, as seen most clearly in FIG. 2, the side edges of the top plate 18 are cut away adjacent the region of attachment of a deck beam to form notches 26 in the top plate which reveal portions 28 of the flanges 20. The weld line 22 follows the configuration of the notches 26 to prevent water ingress at the notch locations. Bolt holes 30 for attachment of the deck beams 16 pass through the flange portions 28 outboard of the weld line 22 and hence do not compromise the integrity of the sealed log.

As shown in FIGS. 3, 3*a* and 4, a deck beam 16, in the present instance having a channel shape, is attached to each of the pontoon logs by means of bolts 32 at each side of each log. The bolts 32 pass through holes 30 in the hull flange portions 28 and through holes 34 in the deck beam lower flange 36 which is seated directly on the log top plate 18. The holes 30 and 34 obviously require no caulking, and, in fact, may be made slightly oversized to facilitate alignment and assembly.

The size and shape of the notches 26 is not critical, the dimension transversely of the pontoon log being governed by the size of the flange and the size and location of the holes 30. In the embodiment illustrated, the notch width is roughly equal to the width of the flange. Similarly, the length of the notches is not critical, the length in the illustrated views being somewhat generous to allow for variation in the location of the deck beams upon assembly of the pontoon. Although shown as rectangular, the notches could be of another shape such as as semi-circular. The illustrated rectangular shape is preferred for manufacturing convenience.

In the embodiment of FIGS. 1–4, the bolts 32 pass through the flange portion 28 and then through an open space where the top plate has been cut out before passing through the deck beam flange 36. In some circumstances, depending upon the thickness of the hull material and the strength of the deck beam flange, overtightening of the bolts or the strains introduced to the hull components during boat usage could result in a deformation of the flange portions 28 and/or the deck beam flanges 36. Accordingly, various modified embodiments are presented which provide arrangements for averting such deformation and for strengthening the pontoon log in the regions of the bolted connections to the deck beams.

Figure 5:
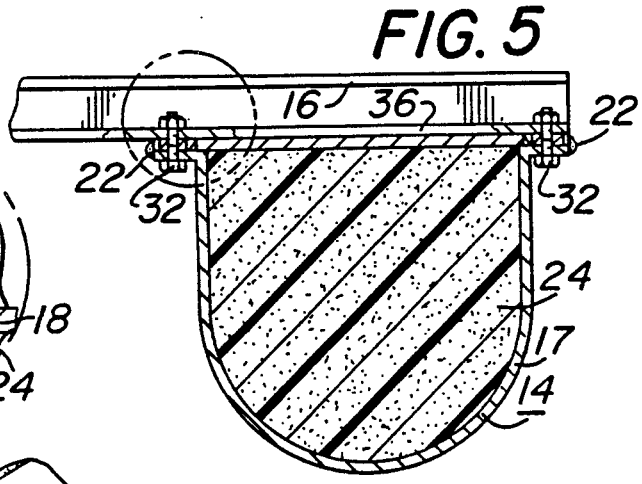
FIG. 5 illustrates a first modified embodiment of the invention and is a sectional view through a pontoon log at the point of connection with a deck beam.
Figure 5A:
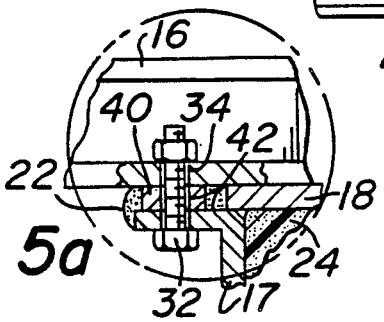
FIG. 5*a* is an enlarged fragmentary sectional view of the area encircled in broken lines in FIG. 5.
Figure 6:
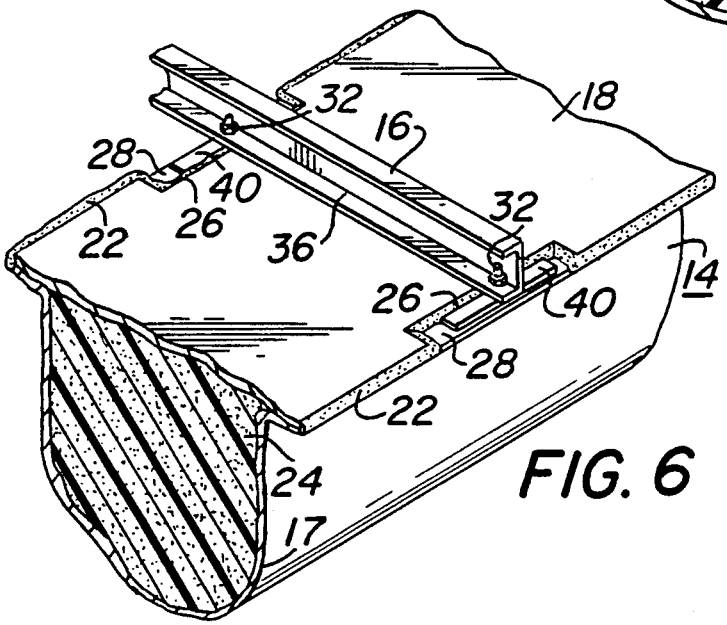
FIG. 6 is a perspective view showing the log/beam connection of FIGS. 5 and 5*a;*

In the embodiment of FIGS. 5, 5*a* and 6, the manner of attachment of the deck beam 16 to the pontoon log 14 is identical to that of the embodiment of FIGS. 1–4 with the addition of a spacer or washer 40 disposed within each notch 26 between the flange portion 28 and the lower flange portion 36 of the deck beam 16. As shown in FIGS. 5 and 5*a*, the spacer 40 has a thickness substantially equal to that of the top plate 18 and permits the tightening of the bolts 32 without danger of deforming either the hull flanges or the deck beam flange. The spacer 40 is preferably of a rectangular shape similar to that of the notch in which it is disposed and accordingly serves to stiffen the flange portion 28 and to minimize the possibility of flange deformation. The spacers 40 each include a central hole 42 for passage of the bolts 32, which hole may be slightly oversized to facilitate assembly.

In the embodiment of FIGS. 7, 7*a* and 8, a clip 44 is employed in place of the spacer 40 of the previously described embodiment. The clip 44 is of a U-shape, and is sized to substantially envelop the flange portion 28 exposed by the notch of the top plate. The clip 44 is slightly narrower and slightly shorter than the notch and serves to stiffen the flange portion 28 in view of its presence both above and below the flange portion. The interior faces 46 of the clip 44 preferably are of a toothed configuration as shown in FIG. 7*a* to grip the flange portion 28. Holes 47 in the clip may be slightly oversized to permit ready passage of the bolts 32'.

The bolts 32' of the embodiment of FIGS. 7, 7*a* and 8 are somewhat longer than the bolts 32 of the previously described embodiments as necessitated by the added thickness of the clips 44. Aside from the clips, the other elements of the illustrated assembly are identical with those of the previous embodiments and bear common reference numerals.

The embodiment illustrated in FIGS. 9, 9*a* and 10 also employs a clip 48 in the region of each notch 26, but the clip 48 is longer than the notches 26 and hence is sized to envelop both the hull flange 20 as well as the top plate 18. Clip 48 includes toothed inner surfaces 50 which serve to lock the clip into place during assembly. The width of the clip 48 is limited to the width of the flange 20 of the hull. Holes 50 in the clip 48 permits passage of bolts 32'', which may be oversized for ease in assembly.

With the arrangement of FIGS. 9, 9*a* and 10, the deck beam 16, in contrast to the previous embodiments, does not seat directly on the top plate 18, but rather is supported on the clips 48 as most readily seen in FIGS. 9 and 9*a*. Accordingly, the bolts 32'' must be longer than those of the previous embodiments to accommodate the additional thickness of the clip. Otherwise, the components of the assembly are identical to those previously described and bear common identifying numbers.

In carrying out the present method, the top plate 18 is cut to form the notches 26 prior to attachment to the hull member 17. The foam 24 is cast or disposed within the hull member following which the top plate and hull flanges are welded along the weld line 22. The bolt holes 30 and 34 may be drilled in a single operation with the deck beams in place on the pontoon logs, or the holes may be drilled in the hull flanges and deck beam independently, preferably utilizing hole alignment devices to ensure a proper hole spacing. Upon the placement and tightening of the bolts 32, the assembly of the pontoon log and deck beam is completed.

Although the deck beams 16 are illustrated as channel shaped, it will be apparent that other shapes could be utilized, such as Z-shaped or tubular rectangular shaped members From the foregoing it may be seen that the present invention provides a watertight pontoon log construction without reliance on resilient seals or caulking materials. The deck beam bolt holes are all outboard of the pontoon log weld line and hence there is no possibility of leakage at the points of bolted deck beam attachment. The construction is extremely simple and hence inexpensive to fabricate. Aside from the welding, the assembly of the pontoon logs and deck beams can be carried out by relatively unskilled workers with a minimal amount of training.

Manifestly, changes in details of construction can be effected by those skilled in the art without departing from the invention.

I claim:

1. A method of attaching a deck beam to a pontoon log, said pontoon log comprising a substantially U-shaped sheet metal hull member having outwardly directed flanges at the upper edges therof and a top plate having side edges extending over said hull member flanges for welded attachment thereto along the peripheral edges thereof, said method comprising the steps of;

cutting out portions of said top plate side edges in the regions beneath said deck beam to expose portions of said hull member flanges;

welding said top plate to said hull member around the edges of said top plate including the edges of said cut out portions; and fastening said deck beam to said pontoon log by bolting said beam to said exposed portions of said hull member flanges.

2. A method of making a pontoon log and attaching said log to a deck beam comprising the steps of;

providing a U-shaped sheet metal hull member having outturned flanges at the upper edges thereof, providing a log top plate having side edge portions adapted to overlie said hull member flanges, notching said top plate edges at predetermined intervals, welding the edges of said top plate to said hull member flanges along a continuous weld line, and bolting a deck beam to said pontoon log by means of throughbolts passing through said hull member flanges in the areas uncovered by the top plate notches.

3. The invention as claimed in claim 2, including the step of reinforcing said hull member flange in the regions of said notches by applying spacers to said flanges within the notches, said spacers having a thickness substantially equal to that of said top plate.

4. The invention as claimed in claim 2, including the step of reinforcing said flanges in the regions of said notches by applying clips thereto through which the beam securing bolts are passed.

5. A pontoon log adapted for bolted connection to a deck beam, said pontoon log comprising;

a U-shaped hull member having outwardly directed flanges at the upper edges thereof, a top plate disposed over said hull member with the side edges thereof overlapping said hull member flanges, notches in said top plate in areas thereof designated for attachment of a deck beam, and a continuous weld line extending along said top plate edges including the perimeter of each of said notches to effect a watertight attachment of said top plate to said hull member flanges.

6. The invention as claimed in claim 2, including bolt holes in said hull member flanges in the areas thereof uncovered by said notches.

7. A pontoon log and deck beam assembly comprising a pontoon log formed by a U-shaped hull member having outwardly directed flanges at the upper edges thereof, and a top plate disposed over said hull member with the side edges thereof overlapping said hull member flanges, a deck beam extending transversely of said pontoon log, notches in said pontoon log top plate on opposite sides thereof in areas thereof designated for attachment of said deck beam, a continuous weld line extending along said top plate edges including the perimeter of each of said notches to effect a watertight attachment of said top plate to said hull member flanges, and bolts extending through said hull member flanges in the areas thereof uncovered by said notches, said bolts extending through said deck beam and serving to secure said deck beam to said pontoon log.

8. The invention as claimed in claim 7, including spacers disposed within said notches between said deck beam and said hull member flanges, said bolts passing through said spacers.

9. The invention as claimed in claim 8, wherein said spacers have a thickness substantially equal to that of said top plate.

10. The invention as claimed in claim 7, including clips disposed around the uncovered portions of said hull member flanges, said bolts passing through said clips.

11. The invention as claimed in claim 10, wherein said clips comprise U-shaped element adapted to fit over said flange portions within said notches.

12. The invention as claimed in claim 10, wherein said clips comprise U-shaped member adapted to fit over said flange portions and said top plate, the length of each said clip being greater than the length of each said notch.

* * * * *